United States Patent [19]

Stark

[11] Patent Number: 5,066,012

[45] Date of Patent: Nov. 19, 1991

[54] POLAR LIGHTED BALL

[76] Inventor: Steven P. Stark, 18355 Yorkshire, Prior Lake, Minn. 55372

[21] Appl. No.: 653,696

[22] Filed: Feb. 11, 1991

[51] Int. Cl.[5] ..... A63B 43/06

[52] U.S. Cl. ..... 273/65 EF; 273/58 G; 273/55 B; 273/DIG. 8; 273/DIG. 20; 362/253; 362/390; 362/369; 446/485; 446/409

[58] Field of Search ..... 273/58 G, 65 EF, 213, 273/DIG. 8, DIG. 20; 362/253, 390, 369; 446/485, 409

[56] References Cited

U.S. PATENT DOCUMENTS

| | | | |
|---|---|---|---|
| 2,020,484 | 11/1935 | Turner | 273/58 G X |
| 3,011,048 | 11/1961 | O'Brien | 240/6.4 |
| 3,229,976 | 1/1966 | Allen, Jr. | 273/58 |
| 3,304,651 | 2/1967 | Deyerl | 273/58 G X |
| 3,458,205 | 7/1969 | Smith et al. | 273/213 |
| 3,610,916 | 10/1971 | Meehan | 446/485 X |
| 3,804,411 | 4/1974 | Hendry | 273/58 |
| 4,002,893 | 1/1977 | Newcomb et al. | 240/6.4 R |
| 4,133,528 | 1/1979 | Koblick | 273/65 EF |
| 4,701,146 | 10/1987 | Swenson | 446/130 |
| 4,776,589 | 10/1988 | Yang | 273/58 |
| 4,957,297 | 9/1990 | Newcomb et al. | 273/213 |

*Primary Examiner*—George J. Marlo

*Attorney, Agent, or Firm*—Robert C. Baker

[57] ABSTRACT

The polar-lighted recreational ball is substantially symmetrical about an axis of the ball body and hasa opposing polar regions at opposite ends of the axis. Axially recessed lighting assemblies at each polar region project light outwardly from the ball through a light passage at the polar regions. An annular cushion collar surrounds each polar light passage to cushion axial impacts on the ball. A skewing member causes the lighting assemblies to skew laterally from the axis upon compression impact approximately along the direction of the axis. The skewing member and the lighting assemblies are located in a channel running through the ball at the axis; and the ball is ideally of a substantially ellipsoidal football shape.

20 Claims, 3 Drawing Sheets

POLAR LIGHTED BALL

BACKGROUND OF THE INVENTION

This invention relates to a new recreational ball and more particularly to a polar lighted recreational ball.

Lighted balls have heretofore been proposed for use in recreational play during the dark hours of the evening or nighttime. However, insofar as known, the essential thrust of earlier workers has been to illuminate the entire ball. Such known constructions have either upset the axial symmetrical balance of the ball or interfered with safe bounce and impact compressibility at different angles and points on the surface of the ball. They have not provided a high degree of safety for play under conditions such as falling on the ball where safe compressibility of the ball in all angles and directions is required. Also, full illumination of balls (especially footballs) provides the nighttime throw receiver with relatively poor or insufficient information regarding the flight characteristics (e.g. spiral, end-over-end, etc.) of the airborne ball for catching it.

SUMMARY OF THE INVENTION

This invention provides a new and uniquely lighted recreational ball having compressibility in all directions without significant hazard to the user and without significant damage to the structure of the ball.

The new recreational ball comprises a resiliently compressible ball body having an axis about which the ball body is substantially symmetrical. Opposing polar regions are at opposite ends of the body axis. A light passage means extends axially through each polar region, and a lighting assembly is recessed axially inward of each such polar region for projecting a light beam axially outward through the light passage means of the polar region.

Preferably the light passage means at each polar region is surrounded by a substantially opaque material; and indeed, the entire ball apart from the light passage means of the polar regions should be and preferably is substantially or totally opaque.

The ball of the present invention may comprise material that fills the body of the ball. Such material may be a foamed elastomeric and resiliently compressible material having open or closed cells.

The structure of the ball of this invention preferably includes a cushion collar surrounding each of the light passage means at the polar regions of the ball. This cushion collar functions to cushion the compression impact force upon the interior lighting assemblies, especially a compression impact along an approximately axial direction. Most preferably, the cushion collar projects outwardly from the ball body at the polar regions and forms an essentially annular collar about the light passage means of the polar regions. Preferably the cushion collar comprises opaque resiliently compressible material such as foamed material.

Another feature of the ball of the present invention is its skewing means. The preferred lighting assemblies for the ball are relatively elongated in the axial direction of the polar lighting. The skewing means causes the lighting assemblies positioned inwardly of the polar regions to skew laterally with respect to the axis upon impact on the ball of a compression force in a direction approximately along the axis. The preferred skewing means comprises a bendably resilient tubular skewing member extending axially within the ball body as a bend-recoverable connector between the recessed lighting assemblies for the polar regions.

The most preferred ball shape for the recreational ball of the invention is ellipsoidal and commonly referred to as a football shape.

An ideal structure for the recreational ball of this invention includes an axial channel, preferably of circular cross section, extending entirely through the ball body and centered on the axis of the ball. The channel is preferably of relatively larger diameter at each end portion of it as compared to the central region of it. An annular shoulder is formed at the inner terminus of each larger diameter end portion where it connects to the central region of smaller diameter. Within the channel is lodged an elongated assembly including the lighting assemblies for polar lighting as well as a medial skew connector between the lighting assemblies. The contours of the elongated assembly substantially match or mate with the contours of the channel to thereby maintain the elongated assembly in the channel against axial dislodgement.

Still other features and benefits and advantages of the invention will be evident as this description proceeds.

DESCRIPTION OF THE PREFERRED EMBODIMENT

Figure 1:
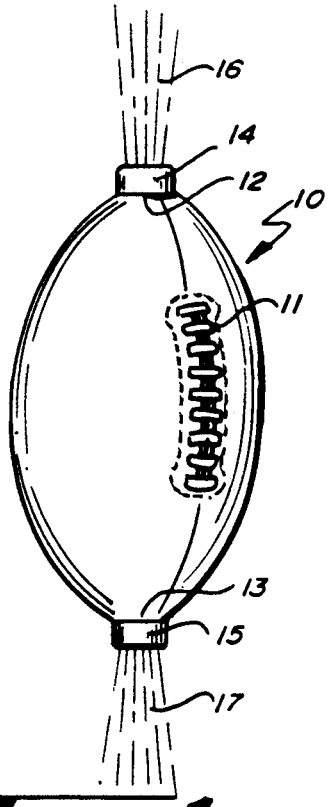
FIG. 1 is a schematic side view of a polar lighted ball of the invention, in a football configuration, showing axially outward light beams projecting from the polar regions of the ball.
Figure 2:
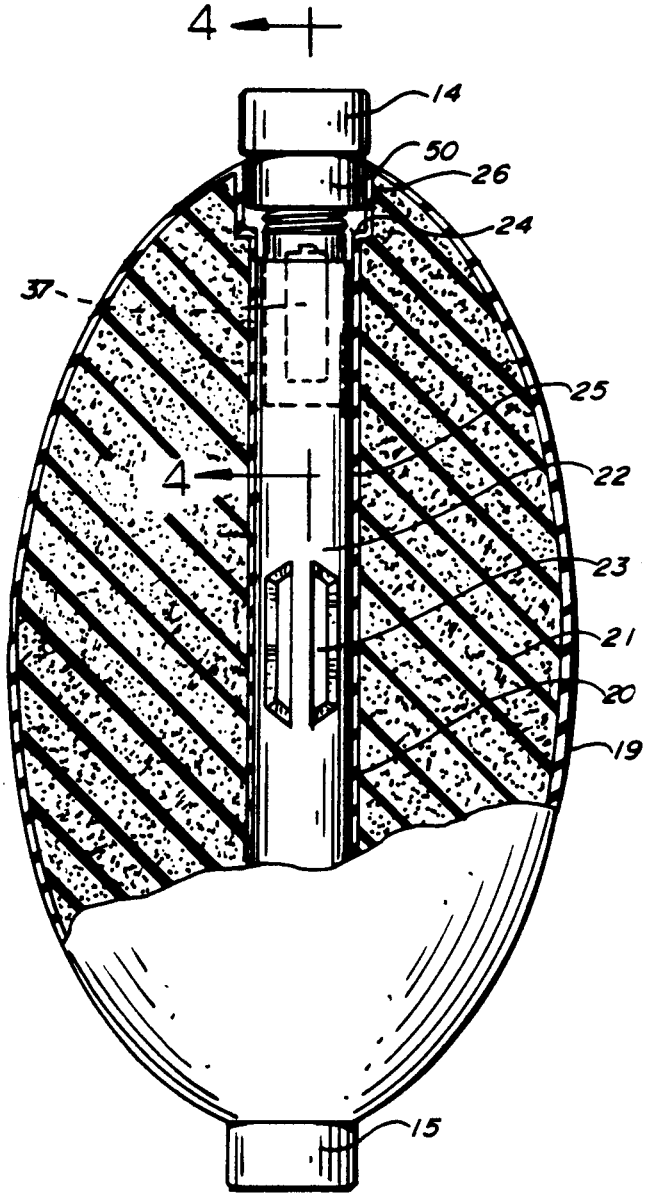
FIG. 2 is an enlarged schematic side view of the football of FIG. 1, with most of the body mass broken away to reveal interior structure along the axis, and with the barrel structure of the uppermost or top lighting assembly partially unscrewed from the battery housing of it.
Figure 3:
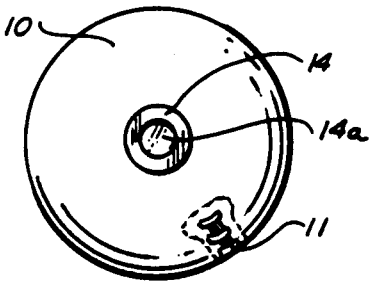
FIG. 3 is a schematic end view of the football illustrated in FIG. 1.

Referring particularly to FIGS. 1, 2 and 3, the recreational ball of the invention, illustrated in football shape, comprises a resiliently compressible ball body 10 having a body axis extending through the center of the football from one end to the other. The axis line is common to the longest dimension of the conventional football shape. The ball body is substantially symmetrical about this axis. In the case of a spherical ball, the body axis would be a diameter line of any selected position; and the relationship of other elements of structure specified herein would be with respect to that selected axis. The usual football is provided with either real or imitation lacing 11. Such lacing is optional and forms no critical part of the invention.

At opposite ends of the axis are opposing polar regions 12 and 13. Each polar region is provided with a cushion collar 14 and 15, and these are illustrated in FIGS. 1 and 2 as projecting outwardly from the polar regions of the ball, giving it a distinctive appearance and functioning to cushion impact on individuals and impact on the interior lighting assemblies. The cushion collars are preferably formed of foamed resiliently compressible material.

Figure 4:
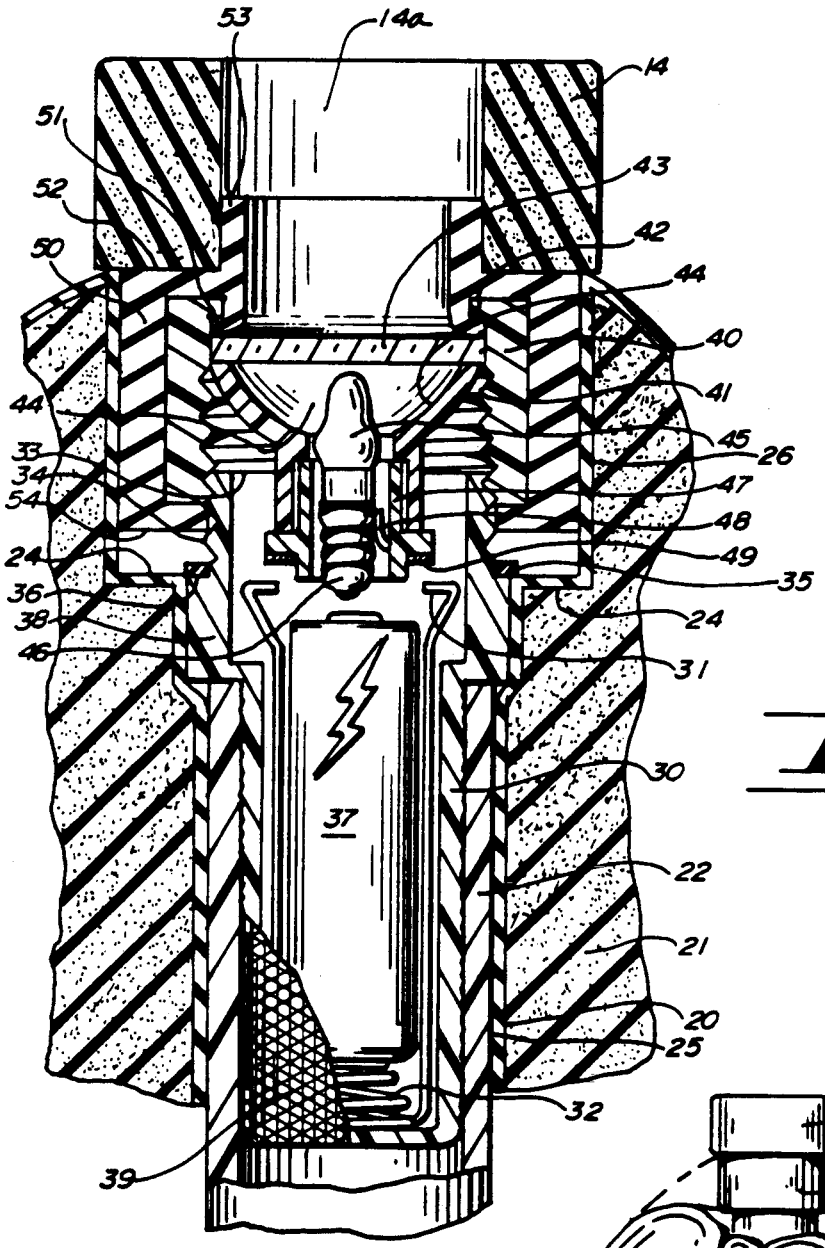
FIG. 4 is an enlarged schematic cross sectional view, taken on line 4—4 of FIG. 2, illustrating details of the interior structure of the ball at on of the opposing polar regions, with much of the ball broken away; the illustration in this figure is with the lighting assembly in the bulb "off" position.

Outwardly from each polar region is a light ray 16 and 17 as illustrated in FIG. 1. Each polar region is provided with a light passage means extending axially through the polar region and this light passage means is marked 14*a* in FIG. 4. A suitable light passage comprises an open passage or light transmitting passage from the interior recessed electrical bulb 45 to the exterior of the ball. Usually, as illustrated in FIG. 4, the light passage 14*a* extending axially outward from the light source 45 will include a transparent or at least translucent plate or lens 43 protecting the light bulb 45. The basic requirement of the light passage means, however, is simply that it provide a passage through the polar region for the movement of light from the interior light source outwardly in a ray from the polar region, as illustrated. The light passage means is suitably defined at its lateral side surfaces by the interior of the cushion collar 14 as well as interior parts or portions of the barrel structure formed of barrel member 40 and barrel augmentation member 50. Preferably, the material of the edges surrounding the light passage is substantially opaque, although modest translucency to light is permissible provided the polar lighting rays are substantially more brilliant than any translucent perimeter or penumbra lighting.

Referring now particularly to FIGS. 2 and 4, the ideal ball of the invention will have a channel 24, 25, 26 extending entirely through the ball body and centered on the axis of the ball. The channel is open at both polar region ends. The channel is preferably substantially circular in cross section and has a relatively larger diameter at each end portion 26 as compared to the medial channel portion or central channel region 25 which extends between the end channel portions 26. An annular shoulder 24 connects the central channel region 25 to the enlarged end channel portions 26. (To be recognized is that the illustration in FIGS. 2 and 4 includes detail for only one polar region and the recessed elements within it as well as detail for a portion of the central channel region 25. The details of structure at the opposite polar region are preferably identical to those of the polar region specifically illustrated in FIGS. 2 and 4.)

An elongated assembly is lodged within the axial channel. This elongated assembly has a medial portion of an external diameter approximating the internal diameter of the central channel region 25, but may be smaller. This medial portion is made up of the battery housing 30 of each lighting assembly and a connector 22 extending between and secured to each battery housing. The preferred connector 22 is tubular and extends over the outer diameter of the battery housings 30 and is frictionally held in place on the battery housings by the irregularities or serrations 39 on their outer surface. Of course, adhesive may be used to hold the connector 22 securely to the housings 30. Each end portion of the elongated assembly is, in a major sense, formed by the barrel structure 40, 50 of the lighting assembly. The basic portion of the barrel structure of the lighting assemblies is the barrel member 40. It is more or less a cylindrical sleeve in nature. This basic portion 40 may have a barrel augmentation 50 for its barrel effect, primarily to increase its outer diameter. Its augmenting cylindrical portion 50 is tightly secured by friction fit or adhesive attachment to the outer surface of the basic barrel member portion 40. The outer diameter of the composite barrel portion 40, 50 of each lighting assembly approximates the diameter of the respective end portions 26 of the channel through the ball. Further, the barrel structure 40, 50 provides an annular shoulder 54 at its axially inward edge for abutment against the annular shoulder 24 of the axial channel through the ball.

Thus, when the barrel structures 40, 50 of the lighting assemblies are tightly attached to their respective battery housings 30, the elongated assembly is lodged in the channel against axial displacement. However, in the preferred embodiment, the elongated assembly of the axial channel is also removable from a lodged condition should one desire to do so. Removal of the elongated assembly from the axial channel is accomplished by removing at least one of the barrel structures 40, 50 from its battery housing 30, and then withdrawing the remainder of the elongated assembly from the other axial end of the ball. Full appreciation of this removal feature is best gained from a clear understanding of the lighting assemblies and they now will be discussed.

Referring particularly to FIG. 4, each recessed polar lighting assembly comprises a battery housing 30 and a barrel member 40, both of which are preferably relatively rigid or non-elastomeric and are suitably formed using relatively stiff plastic such as high impact polystyrene or any other suitable stiff plastic. Metal may be used, but the battery housing 30 and barrel member 40, most preferably, are electrically insulating in character. Both the battery housing 30 and the composite barrel structure 40, 50 are preferably cylindrical for mating relationship with the channel (formed by central or medial region 25, enlarged end parts 26 and shoulder 24).

The size of the battery housing 30 need be little greater than that for accommodating a 1.5 volt AAA battery 37 of conventional character, although a larger sized battery housing accommodating somewhat larger and higher voltage batteries may be employed if desired. A negative electrical strip connector 31 extends from the negative base spring 32 in the closed bottom of the battery housing up the sides of the interior of the housing 30 and terminates in a bent portion forming an arm or arms for making breakable electrical contact with a negative electrical connector 49 carried by the barrel member 40. The battery housing has an open mouth 33 which is oriented to face axially outward within the axial channel of the ball. Exterior threads 3 about the mouth end of housing 30 serve as a fastening component for attachment of the barrel member 40 to the battery housing. At the inner terminus of the threads 34 is an annular shoulder 36. Shoulder 36 extends outwardly from the housing at the axially outward edge of a waist bulge 38 of housing 30. While this battery housing shoulder 36 is optional, it is desirable especially when one desires to form an electrical lighting assembly capable of excluding water from its interior. The shoulder 36 about the battery housing is suitably equipped with an annular gasket 35 for sealing the parts (battery housing 30 and barrel 40) against water entrance to the interior. The outer surface of the battery housings is preferably roughened with serrations 39 for friction attachment of tube connector 22.

Continuing with reference to FIG. 4, the barrel member of each lighting assembly has an interior threaded fastening structure or component 41 for cooperative threaded fastening to the mouth end threads 34 of the battery housing. The bulk of the barrel structure may be increased by employing, as illustrated, a barrel augmentation 50. This provides a substantial shoulder 54 for lodging against the shoulder 24 of the axial channel through the ball when the barrel structure of the lighting assembly is rotatably threaded into a tightened condition on the threads of the battery housing. The material of the barrel augmentation structure 50 suitably may be of tough but bendably resilient character. Flexible plastics or elastomerics are useful for the barrel augmentation, preferably not foamed although modestly foamed material may be employed. The barrel augmentation 50 may extend radially inward at the axial inward end of barrel member 40 and function as a gasket between shoulder 36 of the battery housing and the axially inward edge of barrel member 40.

Inside the barrel member is mounted an electric light bulb 45. Illustratively, at the axially outer end of the barrel member 40 is a radially inward annular flange 42. A transparent or at least translucent plate or lens 43 is lodged against this annular flange 42, preferably with an annular gasket structure 51 interposed therebetween for the purpose of excluding water from the interior of the lighting assembly. Annular gasket 51 may be part of the mass of the barrel augmentation structure 50, as illustrated in FIG. 4. The lens 43 is held in place against the annular flange 42 (with or without a gasket 51 interposed) by any suitable means. Illustratively, reflector 44 of generally parabolic contour is snugly frictionally fitted within the interior of the barrel 40 to hold the lens 43 in place. The structure of the reflector 44 provides a socket 47 for receiving the base mounting portion of the bulb 45. Bulb 45 is mounted in the socket 47 so that the positive electrical tip 46 at the inner mounting end of the bulb 45 is in position for pressure contact on the positive tip of the battery 37 when barrel member 40 is threaded into tightly fastened relationship on battery housing 30. A negative electrical lining 48 in the socket 47 extends to an annular negative plate or ring 49 about the socket 47. Negative ring plate 49 is so proportioned that it will, on threading of the barrel member 40 tightly on the battery housing 30, matingly connect with negative connector 31 of the battery housing.

It should be recognized that the barrel augmentation member 50, which preferably is bendably resilient, is suitably contoured so as to extend in an axial direction as a sleeve 53 within the interior of the cushion collar 14. This arrangement provides a flexible and bendable outwardly directed portion for the composite barrel structure of elements 40 and 50. In addition, it provides a centering member for attachment of the cushion collar 14 to the barrel structure, as by any suitable adhesive. Thus the cushion collar 14 is secured to the outermost shoulder portion 52 of the composite barrel structure and also to the exterior cylindrical surface of the axially outwardly projecting sleeve 53 of the barrel structure.

When the barrel structure (of base member 40 and augmentation body 50) is threaded over the threads of the battery housing 30 at its mouth end and placed in tight fastened relationship to the battery housing, the electrical circuit of the battery housing (consisting of the negative portion 31 from the spring 32 at the base of the battery, plus the positive tip of the battery) is placed in a series electrical current path with the electrical circuit elements of the barrel structure (consisting of the negative portion formed by ring band 49 connected to the socket liner 48 contacting the circumference about the mounting end of the light bulb 45, plus the positive portion at the tip 46 of the light bulb 45) to effect illumination of bulb 45.

Loosely threading the barrel structures of the lighting assemblies upon their respective battery housings puts the barrel structures in connected relationship with their respective battery housings without effecting the electrical contacts necessary to complete the series circuit for illumination of the bulbs of the lighting assemblies. The bulbs remain in darkened condition awaiting use of the ball. But simple movement of each barrel structure into a tight fastened relationship with its respective battery housing serves not only to complete a series electrical path for illumination of the bulb of the lighting assembly, but also to place the shoulder 54 of each barrel structure into abutting relationship with the respective shoulder 24 of the axial channel. In that abutting relationship, the entire elongated assembly in the axial channel of the ball is fixed against any significant dislodgement motion out of the ball.

The lighting assemblies per se, while formed of relatively rigid battery housings 30 and relatively rigid barrel base members 40, are relatively small as compared to the total axial length through the ball. Even so, the invention provides skewing means to protect those relatively rigid structures from damage and to protect a user from injury. The connector 22 provides a preferred skewing system. Connector 22 is preferably formed of a tubular material characterized as being relatively rigid but bendably resilient, meaning that the tubular material is relatively stiff but is bendable and recovers from a bend to assume its original relatively straight tubular condition. It may even exhibit elastomeric properties; but importantly it is relatively stiff and yet easily bendable and readably recoverable from a bended condition. To enhance bendability and yet not interfere with recoverability from bended condition, it is desirable to form apertures 23 in the tubular connector. They weaken the tube at their location and facilitate ready bending of it without interfering with its recoverability from a bent condition. The skewing function of the tubular member arises when the ball is compressed, especially when it is compressed in an approximately axial direction. The tubular member 22, on approximately axial compression, causes the small relatively rigid lighting assemblies inward of the polar regions of the ball to skew laterally with respect to the axis of the ball. This skewing may occur in the case of a football when the ball itself is bent, or when the ball receives impacts in or approximately along the axial direction of the ball, as when a person falls on an end or approximate end of the ball. The skewing of the lighting assemblies in lateral directions with respect to the axis of the ball upon compression impact on the ball body provides not only the benefit of saving the lighting assemblies from serious damage but also the benefit of saving any person who has impacted or fallen on the ball from receiving a serious injury. The preferred material for the connector 22 is rubbery or elastomeric or plastic; and polyethylene is but one suitable plastic to employ.

Figure 5:
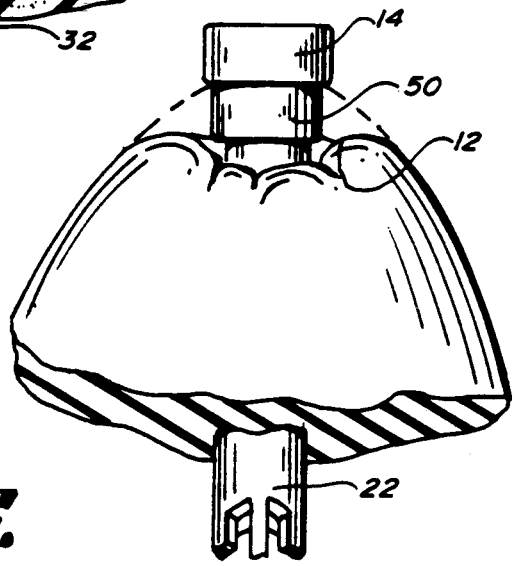
FIG. 5 is a schematic side view of an end polar portion of the football, illustrating manual depression of the ball body around the polar region so as to expose the barrel member of the lighting assembly for manual turning of it to connect or disconnect the electrical circuit path for illumination of the bulb of the lighting assembly.

Since the cushion collars 14 and 15 of the ball are preferably formed of foamed rubbery or elastomeric resiliently compressible material, rotation of them, even though the are fixed to the barrel structure of a lighting assembly, is not the most ideal way of tightening the barrel structures into tight relationship with their battery housings to effect polar lighting of the ball. As illustrated in FIG. 5, the preferred practice is to manually depress the body of the ball away from the cushion collar so as to expose the barrel structure for easy hand rotation of it to thread it into tight relationship on the battery housing. Thereafter the polar region of the ball body that was hand depressed or manually depressed is allowed to assume its normal shape as illustrated in FIGS. 1 and 2.

Referring to FIG. 2, preferred balls of the invention will have an opaque outer integument or skin 19 of substantially continuous nature (i.e., non-porous) and exhibit substantial imperviousness to water penetration. The outer integument 19 should continue as an inner integument 20 lining the axial channel through the ball. The outer 19 and inner 20 integuments should be fused or united to each other at the polar regions. Although the ball body between the outer and inner integuments may be hollow or air inflatable, such is not preferred. The preferred ball bodies of the invention comprise resiliently compressible elastomeric material 21 extending throughout the body between the inner and outer integuments. Foamed elastomeric material, whether of closed or open cells is most ideal. As used herein, elastomeric material is intended to embrace all resiliently compressible materials whether of natural o synthetic origin.

Preferably the force applied by a human hand should be sufficient to compress the body of the ball. This enhances ready grippability for recreational play. The outer integument of the ball body may have a texture or roughness to enhance non-slip grip by the human hand.

Figure 6:
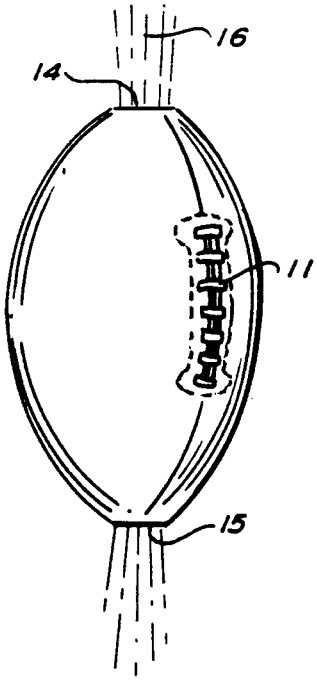
FIG. 6 is a schematic side view of a modified polar lighted ball according to the invention, with the cushion ends or collars recessed so as not to extend or project outwardly from the polar regions.
Figure 7:
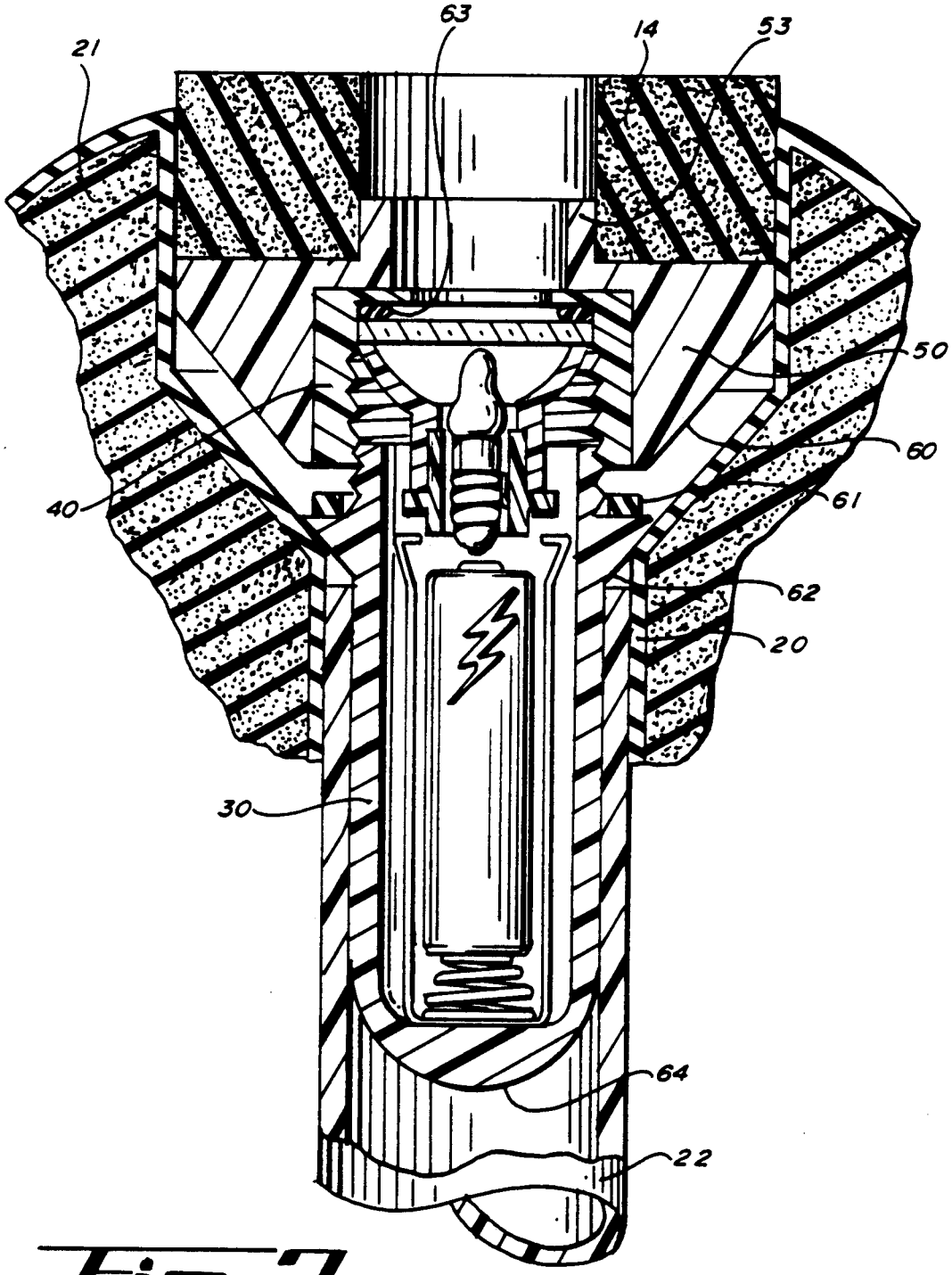
FIG. 7 is a schematic cross sectional view along the axis of the ball of FIG. 6, with a large portion broken away, illustrating an alternative contour for the lighting assembly configuration and particularly illustrating a conical shoulder on the barrel member of the lighting assembly (illustrated in bulb "off" position) and a hemispherical contour for the innermost end of the battery housing for the lighting assembly.

Referring now to FIGS. 6 and 7, the outward projection of the cushion collars of the ball may be avoided by placing the cushion collars in a recessed condition within the polar regions 14 and 15 of the ball body. This may be desirable for those who wish to preserve the basic football appearance and avoid polar projections. FIG. 7 illustrates a preferred conical slope for the shoulder 60 of the barrel augmentation 50. The conical nature of the slope for the shoulder 60 is continued through to a conical slope 62 for the axially inward or bottom portion of the bulge of the battery housing. The bulge slope 62 of course forms a shoulder for gasket 61. The annular gasket 63 provides a seal against water penetration at the lens end of the barrel structure.

While FIG. 7 illustrates a tubular connector 22 comparable to that illustrated in FIGS. 2 and 4, an important point to be made is that the tubular connector may be omitted. Thus a ball may be formed with the lighting assemblies in recessed condition at each polar end, and with foamed elastomeric body mass for the ball extending through the axial line between the axially inward ends of each battery housing. If such is done, the axially inward ends of the battery housings preferably are contoured to assist in causing skewing action. The hemispherical axially inward ends 64 of the battery housings are for this purpose. They function in combination with any material between them to cause the battery housings (and indeed the entire lighting assemblies) to skew from the axially orientation upon severe compression of the ball in a direction approximately along the axis of the ball. Skewing on axial compression is particularly important when the battery housings employed are relatively long and have a relatively small medial distance between them. Where a connecting skewing member is omitted and the lighting assemblies are recessed in pockets axially inward of each polar region, it is preferred to mount the battery housings 30 in exceedingly tight or snug relationship to interior pocket surfaces; and adhesive mounting is recommended. For the embodiment of the invention particularly illustrated in FIGS. 2 and 4, adhesive mounting of the axially elongated assembly is not necessary although the elongated assembly should be so contoured as to fit snugly within the axial channel of the ball.

The polar lighted ball gives a recreational player a unique ability to observe the behavior of the ball during night usage. The receiving player is able to judge the motion of the ball by observing the light beams emitted from the polar regions. For example, if the flight of the polar lighted football is in a perfect or near perfect spiral, the receiving player should see a single unwavering beam of light with little or no wobble. As the deviation from a perfect spiral increases, so also does the light beam wobble. At the other extreme, an end-over-end flight (such as may result from a kick) causes the receiving viewer to see a rapidly flickering light beam. The receiver's knowledge of the flight characteristics of the football enhances the receiver's ability to catch the ball much the same as during daylight hours when the thrown ball is more readily visible.

The skewing means provides a unique way of protecting the lighting assemblies, other objects and also the players from damage or injury; and this enhances the protective function of the cushion collars. The ball presents little danger of injury to the player as a result of being struck by the ball or as a result of falling on the ball. This feature is of even greater importance during night usage, when the possibility of being struck by the ball or falling upon the ball is greatly increased.

Interchangeable lens or plates element 43 of different user-selected colors may be employed. The outer integument of the ball may be visually enhanced by the use of florescent colors or patterns.

Further, those skilled in the art will readily recognize that this invention may be embodied in still other specific forms than illustrated without departing from the spirit or essential characteristics of it. The illustrated embodiments are therefore to be considered in all respects illustrative and not restrictive, the scope of the invention being indicated by the appended claims rather than the foregoing description; and all variations that come within the meaning and range of equivalency of the claims are therefore intended to be embraced thereby.

That which is claimed:

1. A recreational ball comprising:

(i) a resiliently compressible ball body having an axis about which said ball body is substantially symmetrical and having opposing polar regions at opposite ends of said axis, (ii) a light passage means extending axially through each said polar region, and (iii) a lighting assembly recessed axially inward of each said polar region for projecting a light beam axially outward through said light passage means thereof so that a receiving player is able to judge the motion of the ball by observing the light beams emitted from the polar regions.

2. The ball of claim 1 wherein each said light passage means is surrounded by substantially opaque material.

3. The ball of claim 1 wherein said ball body comprises a substantially ellipsoidal football shape.

4. The ball of claim 1 additionally including a cushion collar surrounding each said light passage means.

5. The ball of claim 4 wherein each said cushion collar projects outwardly from said ball body at said polar regions.

6. The ball of claim 5 wherein each said cushion collar comprises opaque resiliently compressible material.

7. The ball of claim 6 wherein said ball body comprises a substantially ellipsoidal football shape.

8. The ball of claim 1 additionally comprising skewing means for causing said lighting assemblies inward of said polar regions to skew laterally with respect to said axis upon compression of said ball body in a direction approximately along said axis.

9. The ball of claim 8 wherein said skewing means comprises a bendably resilient skewing member extending axially within said ball body as a bend-recoverable connector between said recessed lighting assemblies.

10. The ball of claim 1 additionally comprising a channel extending entirely through said ball body and centered on said axis, said channel having open ends at each said polar region, each said lighting assembly being recessed within said channel.

11. The ball of claim 10 wherein each said lighting assembly comprises a battery housing and a barrel structure containing an electric bulb, said barrel structure being axially outward from said battery housing and removably attached thereto.

12. The ball of claim 11 wherein said channel is substantially circular in cross-section, has a relatively larger diameter at each end portion thereof as compared to the central channel region extending between said channel end portions, and has an annular shoulder at the juncture between each said larger diameter channel end portion and said central channel region, and wherein an elongated assembly of substantially circular cross-section is lodged within said channel, said elongated assembly having end portions of a diameter approximating the diameter of said channel end portions and having a medial portion of a diameter approximating the diameter of said central channel region, each said end portion of said elongated assembly comprising said barrel structure of a said lighting assembly, said medial portion of said elongated assembly comprising the battery housing of each said lighting assembly and a connector extending between and attached to each said battery housing, each said barrel structure of a said lighting assembly having an inward shoulder, said inward shoulders of said barrel structures being in abutting relationship to said annular shoulders of said channel when said barrel structures ar attached to their respective battery housings of said medial portion of said elongated assembly, to thereby maintain said elongated assembly in said channel against axial dislodgement.

13. The ball of claim 1 additionally comprising a skewing means for causing said lighting assemblies inward of said polar regions to skew laterally with respect to said axis upon compression impact of said ball body in a direction approximately along said axis.

14. The ball of claim 13 wherein said skewing means comprises a bendably resilient tubular member extending axially within said channel as a bend-recoverable connector between said lighting assemblies.

15. The ball of claim 14 wherein said tubular member has walls containing apertures to weaken said tubular member for bending of it.

16. The ball of claim 10 additionally comprising a flexible outer integument forming the outer surface of said body, a flexible inner integument lining said channel and unified to said outer integument at said polar regions, said outer and inner integuments being substantially impervious to water, and wherein each said lighting assembly comprises means for excluding water from the interior thereof.

17. The ball of claim 16 wherein said ball body between said outer and inner integuments comprises resiliently compressible elastomeric material.

18. The ball of claim 17 wherein said resiliently compressible elastomeric material comprises a foamed material.

19. The ball of claim 1 wherein the said lighting assembly axially inward of each said polar region comprises a battery housing having an open mouth for receiving a battery and an exterior fastener component about said mouth and an annular exterior shoulder at the inner terminus of said exterior fastener component, said battery housing having its open mouth oriented to a said polar region, a barrel member for fitting over the open mouth of said battery housing, said barrel member having an interior fastener component for removable attachment to said exterior fastener component of said battery housing, said barrel member being axially outward from said battery housing and axially inward from said polar region, an electrical light bulb inside said barrel member and oriented to project light axially outward through said light passage means, and a battery housing electrical circuit and a barrel member electrical circuit for forming a series electrical path to illuminate said electrical light bulb.

20. The ball of claim 19 wherein said series electrical circuit path is rendered continuous for illumination of said light bulb by movement of said barrel member into tight fastened relationship with said battery housing and broken by movement of said barrel member into relatively loose but connected relationship to said battery housing.

* * * * *